US005352339A

United States Patent [19]

Kozawa et al.

[11] Patent Number: 5,352,339

[45] Date of Patent: Oct. 4, 1994

[54] METHOD FOR PRODUCING ELECTROLYTIC MANGANESE DIOXIDE

[76] Inventors: Akiya Kozawa, 39-2 Youke, Ukino, Chinkicho Ichinomiya-shi Aichiken 491; Kenzo Matsuke, Fac. of Engr. Yamagato Univ. 4-3-16 Jyonah, Yonezawa Yamogataken 992, both of Japan

[21] Appl. No.: 59,418

[22] Filed: May 4, 1993

[51] Int. Cl.[5] ..... C25B 1/00

[52] U.S. Cl. ..... 204/96; 423/449.3

[58] Field of Search ..... 204/96; 423/449.3

[56] References Cited

U.S. PATENT DOCUMENTS 3,442,679 5/1969 Rivin et al. ..... 423/449.3

4,997,531 3/1991 Yoshio et al. ..... 204/96

*Primary Examiner*—John Niebling

*Assistant Examiner*—Brendan Mee

[57] ABSTRACT

A method of producing electrolytic manganese dioxide by electrolyzing an electrolyte containing sulfonated carbon particles preferably in an amount of 0.1 to 1.0 gram per liter of the electrolyte.

14 Claims, 1 Drawing Sheet

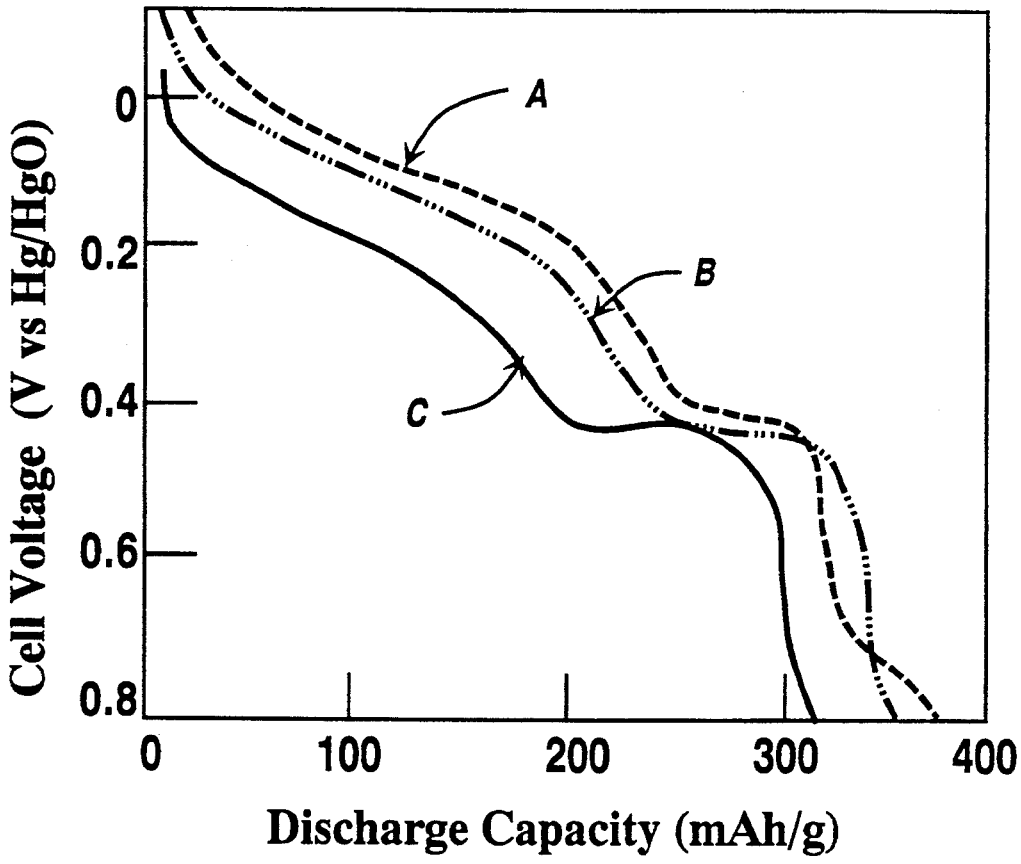
A
B
C
0
0.2
0.4
0.6
0.8
Cell Voltage (V vs Hg/HgO)
0
100
200
300
400
Discharge Capacity (mAh/g)

METHOD FOR PRODUCING ELECTROLYTIC MANGANESE DIOXIDE

FIELD OF THE INVENTION

The invention relates to a method of manufacturing electrolytic manganese dioxide for electrochemical cells by electrolyzing an electrolyte containing sulfonated carbon particles.

BACKGROUND OF THE INVENTION

Electrolyte manganese dioxide (EMD) can be presently produced by using titanium, lead or graphite as the anode for an electrolyte of a manganese sulfate solution. Preferably, the use of a titanium anode has been used to obtain good electrolytic manganese dioxide. When using the titanium anode, the upper limit of the current density has been found to be 0.8 to 1.0 ampere per square centimeter. If the current density exceed this limit, it has been observed that a passive film is formed on the titanium electrode and the voltage of the electrolytic cell increases rapidly so that the electrolysis can not continuously be performed. To overcome the passavation of the titanium electrode and the associated voltage increase, it has been proposed in Japanese patents Kokai Sho 47-42711 and Kokai Sho 61-47911 to use suspension of EMD, or acetylene or carbon black powders, respectively, in the electrolytic bath. This process is called a slurry bath.

In the operation of the slurry process, making a stable carbon powder suspension in the electrolyte is difficult since the carbon particles, such as acetylene black, are hydrophobic and therefore are difficult to wet.

It is an object of the present invention to effectively eliminate the difficulty of making a good suspension of carbon particles in an electrolytic bath by the method of sulfonizing the surface of the carbon particles prior to their being fed into the electrolytic bath. Various carbon particles are suitable for use in this invention such as acetylene black, carbon black, and the like. However, the preferred carbon particles are acetylene black.

The sulfonation of the surface of carbon particles can be accomplished by mixing carbon particles, such as acetylene black, and fumic sulfuric acid. The temperature of the mixture will rise (generally to about 70° C.) due to its exothermic reaction. After standing for a suitable period, for example over night, the mixture cools to room temperature. The carbon particles are then separated by filtration and the surface of such particles will be sulfonized. The sulfonated carbon particles are easily dispersed in the electrolyte of the ENID production bath and EMD can be readily produced. The EMD produced using the sulfonated carbon particles have been found to contain some carbon and have a good discharge capability while also being easy to grind. Therefore the production method of this invention is better than the existing processes since it produces electrolytic manganese dioxide that has good discharge capability, good grinding characteristics and can produced EMD in the process at higher current density, for example up to three times greater current density than the conventional process.

The sole drawing is a plot of discharge capacity (mAh/g) versus cell voltage (V vs Hg/HgO) for various types of electrolytic manganese dioxide.

EXAMPLE

To make sulfonated acetylene black, 4 grams of acetylene black was mixed with 100 ml of 30% fumic sulfuric acid. The mixing ratio is not critical. The weight ratio could be 4 g:200 g. The temperature of the mixture increased to about 70° C. and was stirred for about 2 hours at 70° C. To stop the reaction, 750 cc of water was added. The sulfonated carbon was separated by centrifuge and washed with water. It was then dried at 80° C. The dried material was ground to fine powder for use in an electrolytic bath. The acetylene black was extremely fine with the particles being about 0.05 μM in size.

A less preferable process would be to boil acetylene black in a 97% $H_2SO_4$ solution for several hours. The acetylene black could then be separated as discussed above. This process produces useable acetylene black in which at least a portion of the surface of the particles are sulfonized.

An experimental electrolytic bath of 10 liter was operated for producing electrolytic manganese dioxide using a titanium-nickel (5% N) alloy plate as the anode. The cathode was a graphite plate. The electrolyte was a mixture of 0.65M $MnSO_4$ and 0.4M $H_2SO_4$ in which various amounts of sulfonated acetylene black (S-AB) was suspended in the bath as shown in the Table. The bath temperature was 90°±1° C. and the current density was 2.0 A/cm$^2$. After 72 hours continuous electrolysis, the deposited EMD on the anode plate was removed. The EMD was ground to a battery grade powder with an average size of about 20 μM and washed, neutralized and dried. The results of the data observed are shown in the Table along with the results of the prior art EMD.

TABLE

| Exp | Suspended solid powder | Conc. of suspension (% P) | Current Density (A/dm$^2$) | Time of electrolysis | Cap mAh/g | AB content (wt %) | BET surface M$^2$/g |
|---|---|---|---|---|---|---|---|
| | | Currently Invented Process | | | | | |
| 1 | S-AB | 0.1 | 2.0 | 72 | 230 | 0.01 | 32.1 |
| 2 | S-AB | 0.3 | 2.0 | 72 | 241 | 05 | 28.9 |
| 3 | S-AB | 0.5 | 2.0 | 72 | 248 | 0.26 | 25.6 |
| 4 | S-AB | 0.7 | 2.0 | 72 | 237 | 0.31 | 22.9 |
| 5 | S-AB | 1.0 | 2.0 | 72 | 225 | 0.42 | 17.5 |
| | | Regular Invented Process | | | | | |
| 6 | AB# | 0.5 | 2.0 | 72 | 228 | 0.08 | 35.1 |
| 7 | EMD | 0.5 | 2.0 | 72 | 246 | — | 26.1 |
| 8 | None | — | 0.5 | 144 | 239 | — | 34.8 |

#acetylene black

The discharged capacity was measured with an experimental cell using 100 mg of EMD powder at a constant current of 1.0 mA/cm$^2$ in 9M KOH. The cell voltage was measured against a Hg/HgO reference electrode and the cut-off voltage was 400 mV versus the reference electrode. From the data, the addition of S-AB in the amount of 0.5 g/l was the best for the discharge capacity as shown in the Table. The drawing shows the comparison of the discharge curves of various EMD samples. Curve A represents EMD produced using 0.5 g/l of sulfonated acetylene black; Curve B represents EMD produced using 0.2 g/l of EMD powder suspension; and Curve C represents no solid powder added.

Acetylene black (AB) is highly hydrophobic and does not wet easily in the $MnSO_4$ solution. Therefore by using S-AB we can add AB very easily in the desired amount. Use of small amounts of S-AB in the EMD bath will produce EMD that contains some carbon and said EMD can be easily ground. Without using the S-AB, the deposited EMD is not only hard to grind to the desired powder size (usually 5 to 20 $\mu$M) but metallic contamination can take place since the grinder hammer is usually an iron alloy. Therefore the invention is directed to the use of S-AB for producing electrolytic manganese dioxide. Preferably, in the electrolytic bath, the amount of S-AB to be added is from 0.5 to 2.0 g/l with 0.1 to 1.0 g/l being preferable.

What is claimed:

1. Method for producing electrolytic manganese dioxide for an electrochemical cell by electrolyzing an electrolyte which contains carbon black or acetylene black particles in which the surface is at least partially sulfonized and assembling the electrolytic manganese dioxide in an electrochemical cell.

2. The method of claim 1 wherein the particles are present in an amount of 0.05 to 2.0 grams per liter of the bath.

3. The method of claim 2 wherein the particles are present in an amount of 0.1 to 1.0 gram per liter of the bath.

4. The method of claim 1 wherein a titanium or titanium alloy electrode is used with the electrolyte.

5. The method of claim 4 wherein a graphite cathode electrode is used with the electrolyte.

6. The method of claim 1 wherein the electrolyte comprises a mixture of $MnSO_4$ and $H_2SO_4$.

7. The method of claim 6 wherein the particles are present in an amount of 0.05 to 2.0 grams per liter of the bath.

8. The method of claim 7 wherein the particles are present in an amount of 0.1 to 1.0 gram per liter of the bath.

9. The method of claim 6 wherein a titanium or titanium alloy electrode is used with the electrolyte.

10. The method of claim 6 wherein a graphite cathode electrode is used with the electrolyte.

11. The method of claim 1 wherein the particles are acetylene black.

12. The method of claim 3 wherein the particles are acetylene black.

13. The method of claim 6 wherein the particles are acetylene black.

14. The method of claim 7 wherein the particles are acetylene black.

* * * * *